US006722293B2

(12) United States Patent
Lee

(10) Patent No.: US 6,722,293 B2
(45) Date of Patent: Apr. 20, 2004

(54) FOLDABLE TABLE FRAME

(75) Inventor: Yu-Shu Lee, Taichung (TW)

(73) Assignee: P & F Brother Industrial Corporation, Taichung (TW)

( * ) Notice: Subject to any disclaimer, the term of this patent is extended or adjusted under 35 U.S.C. 154(b) by 62 days.

(21) Appl. No.: 10/259,135

(22) Filed: Sep. 26, 2002

(65) Prior Publication Data

US 2004/0025759 A1 Feb. 12, 2004

(51) Int. Cl.[7] ..... A47B 3/02
(52) U.S. Cl. ..... 108/118; 108/175; 108/170
(58) Field of Search ..... 248/165, 431, 248/171, 440.1, 436, 439, 166, 188.6, 277.1, 286.1, 432, 434, 440; 108/50.01, 115, 163, 179, 167, 170, 171, 173, 175, 118, 120; 269/289 R

(56) References Cited

U.S. PATENT DOCUMENTS 152,947 A * 7/1874 Hall ..... 108/170
559,743 A * 5/1896 Ormsby ..... 108/25
1,248,044 A * 11/1917 Webster ..... 108/159
1,274,973 A * 8/1918 Allen ..... 108/175
1,930,176 A * 10/1933 Metzler ..... 108/175
2,695,829 A * 11/1954 Martinez ..... 108/175
2,957,588 A * 10/1960 Muller ..... 108/171
4,245,849 A * 1/1981 Thiboutot ..... 280/20
6,182,935 B1 * 2/2001 Talesky ..... 248/436
6,581,228 B1 * 6/2003 Boskovich et al. ..... 5/655

* cited by examiner

*Primary Examiner*—Janet M. Wilkens
(74) *Attorney, Agent, or Firm*—Merchant & Gould, P.C.

(57) ABSTRACT

A foldable table frame includes a rectangular tabletop unit and a leg unit. The tabletop unit includes U-shaped front and rear frame members pivoted to each other so as to be foldable toward and unfoldable from each other. The leg unit includes two X-shaped leg frame portions, each including first and second leg members pivoted to each other and having upper ends pivoted respectively to the front and rear frame members. The leg members are movable together with the front and rear frame members when the front and rear frame members are moved pivotally relative to each other. The leg members are folded toward each other, and extend into recesses formed in bottom sides of the front and rear frame members when the tabletop unit is folded.

8 Claims, 12 Drawing Sheets

FOLDABLE TABLE FRAME

BACKGROUND OF THE INVENTION

1. Field of the Invention

The present invention relates to a foldable table frame for supporting a machine set thereon, more particularly to a foldable table frame which occupies a relatively small amount of space when folded.

2. Description of the Related Art

Referring to FIGS. 1 and 2, a known table frame 20 for supporting a machine set (not shown) thereon is shown to include a rectangular tabletop unit 21 and a foldable leg unit 22. The tabletop unit 21 is mounted horizontally on top of the leg unit 22 when the latter is unfolded. The tabletop unit 21 includes front and rear rods 211 and a pair of lateral rods 215 interconnecting the front and rear rods 211. The leg unit 22 includes X-shaped front and rear leg frame portions 221 mounted on the front and rear rods 211, respectively, and a pair of linking rods 225 interconnecting the front and rear leg frame portions 221. Each of the front and rear leg frame portions 221 has leg members 223 disposed in a criss-crossing arrangement and pivoted to each other at middle sections thereof. Each of the leg members 223 has an upper end pivoted to a corresponding one of the front and rear rods 211 using a respective pivot axle 222 that extends through a respective elongated slot 212 formed in the corresponding one of the front and rear rods 211. The pivot axle 222 is slidable along the slot 212 during folding and unfolding operation of the table frame 20. Each of the front and rear rods 211 has an inner side provided with a retaining plate 23 which is biased to move downwardly and which has a bottom edge formed with a pair of notch sets, each including a first notch 231 for engaging a corresponding pivot axle 222 when the leg unit 22 is folded so as to retain the leg unit 22 in a folded position, and a second notch 231' for engaging the corresponding pivot axle 222 when the leg unit 22 is unfolded so as to retain the leg unit 22 in an unfolded position. The retaining plate 23 is formed with a handle extension 232. In use, the handle extensions 232 are lifted upwardly to disengage the retaining plates 23 from the pivot axles 222 so as to permit folding and unfolding of the leg unit 22.

However, it is noted that the conventional table frame 20 has a relatively large thickness when the leg unit 22 is folded upon the tabletop unit 21. Moreover, since the tabletop unit 21 is unfoldable, the conventional table frame 20 still occupies a relatively large amount of space in its folded state.

SUMMARY OF THE INVENTION

Therefore, the main object of the present invention is to provide a foldable table frame which has a reduced thickness and which occupies a relatively small amount of space when folded. Accordingly, the foldable table frame of the present invention includes a tabletop unit and a leg unit. The tabletop unit includes front and rear frame members, each of which has a U-shaped configuration. The front frame member includes parallel first lateral rods with front and rear ends and a horizontal front bar extending transversely between the front ends of the first lateral rods. The rear frame member includes parallel second lateral rods with front and rear ends and a horizontal rear bar extending transversely between the rear ends of the second lateral rods. Each of the front and rear frame members has a top wall. The rear ends of the first lateral rods of the front frame member are connected pivotally and respectively to the front ends of the second lateral rods of the rear frame member such that the front and rear frame members are pivotable relative to each other about a horizontal upper pivot axis parallel to the front and rear bars. Each of the first and second lateral rods of the front and rear frame members has a bottom side formed with a recess. The rear end of each of the first lateral rods has an end plate, which has a convex edge. The front end of each of the second lateral rods has an end piece which is pivoted to the end plate of the respective one of the first lateral rods for pivoting about the upper pivot axis and which has an abutment portion that is transverse to the end plate of the respective one of the first lateral rods. The table top unit is movable between an unfolded position, in which the top wall of the front frame member extends horizontally and is coplanar with the top wall of the rear frame member, and a folded position in which the first and second lateral rods are turned upright to enable the front and rear bars to move proximate to each other. The convex edge on the rear end of each of the first lateral rods moves along the abutment portion on the front end of the respective one of the second lateral rods during movement of the front and rear frame members between the folded and unfolded positions. The leg unit includes a pair of X-shaped leg frame portions, each of which includes first and second leg members having upper and lower ends and intermediate sections pivoted to each other about a lower pivot axis that is located below and that is parallel to the upper pivot axis. The upper ends of the first leg members of the leg frame portions are pivoted respectively to the first lateral rods of the front frame member about a horizontal front pivot axis parallel to the upper pivot axis. The upper ends of the second leg members of the leg frame portions are pivoted respectively to the second lateral rods of the rear frame member of the tabletop unit about a horizontal rear pivot axis parallel to the front pivot axis. The first and second leg members of each of the leg frame portions are movable together with the first and second lateral rods, and pivot relative to each other about the lower pivot axis for folding toward and for unfolding from each other when the tabletop unit is moved between the folded and unfolded positions. The first and second leg members of the leg frame portions extend respectively into the recesses of the first and second lateral rods of the front and rear frame members of the tabletop unit when the tabletop unit is moved to the folded position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
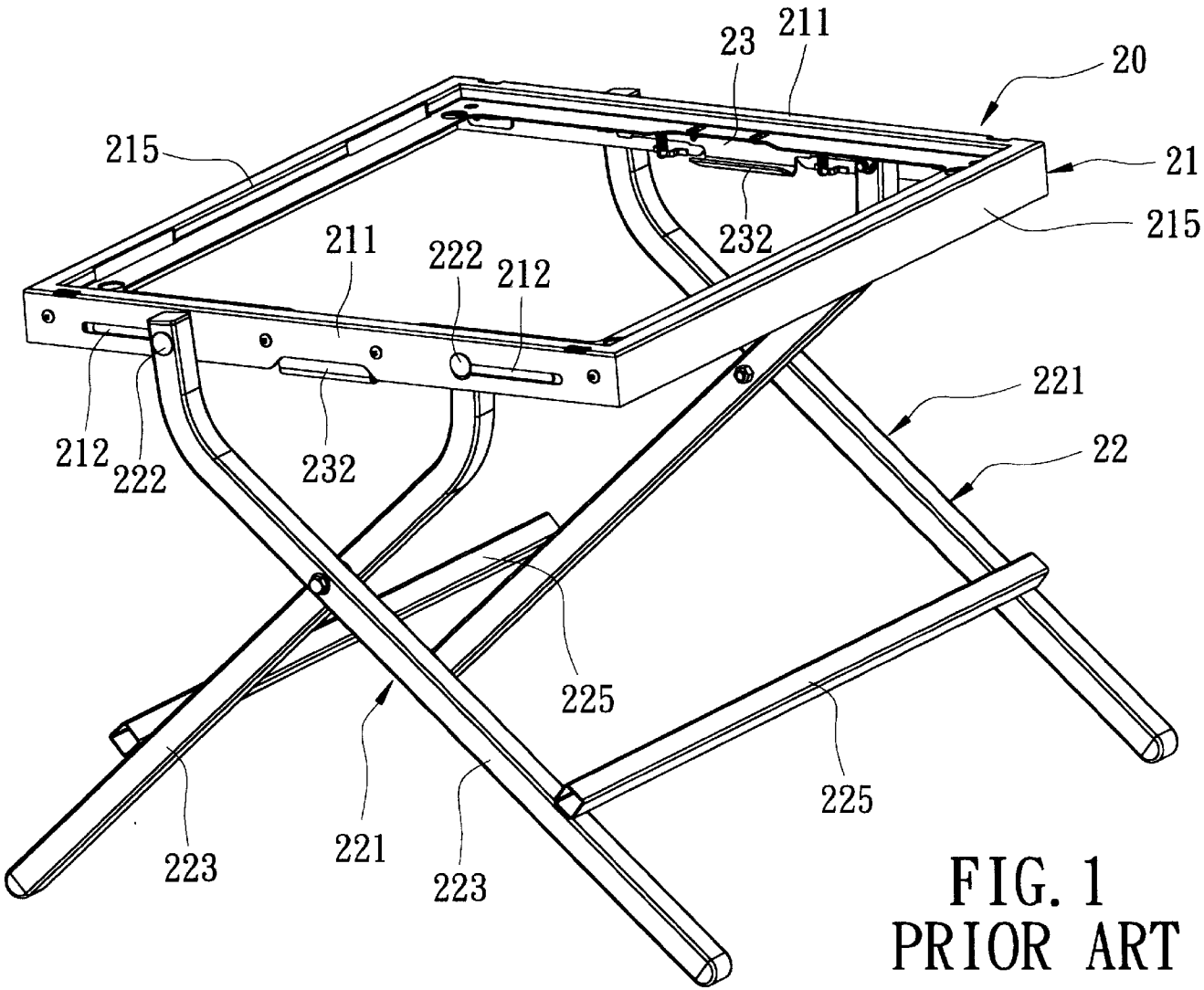
FIG. 1 PRIOR ART
FIG. 1 is a perspective view of a conventional table frame in an unfolded state.
Figure 2:
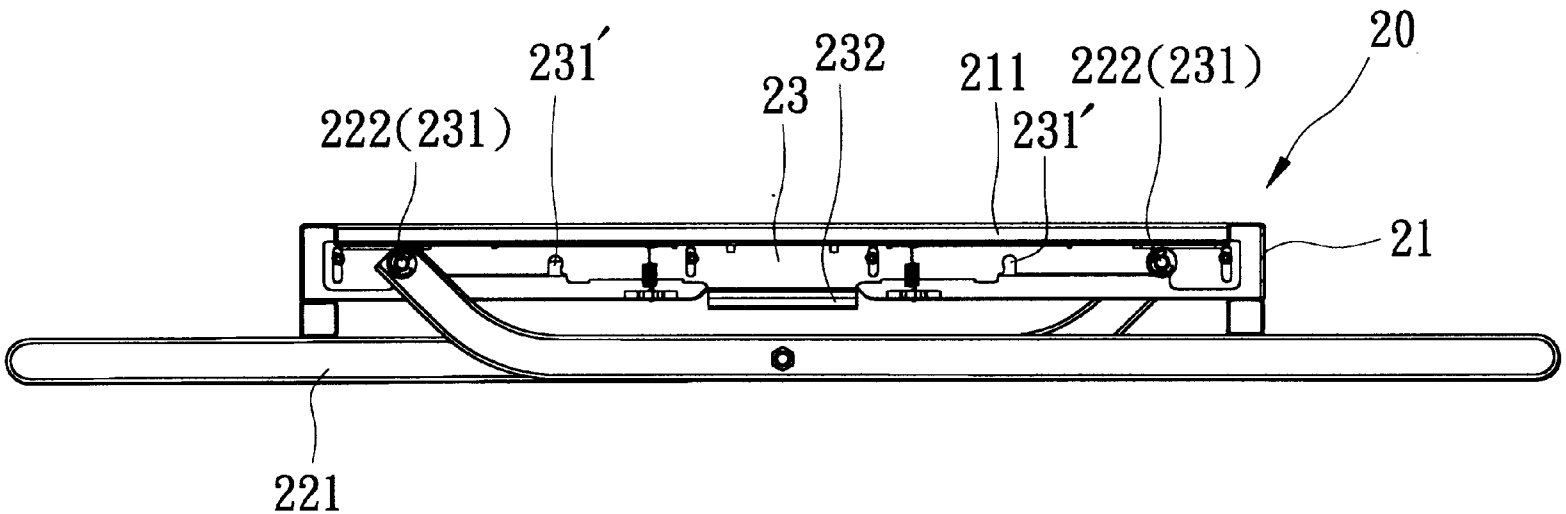
FIG. 2 PRIOR ART
FIG. 2 is an elevational view of the conventional table frame in a folded state.
Figure 3:
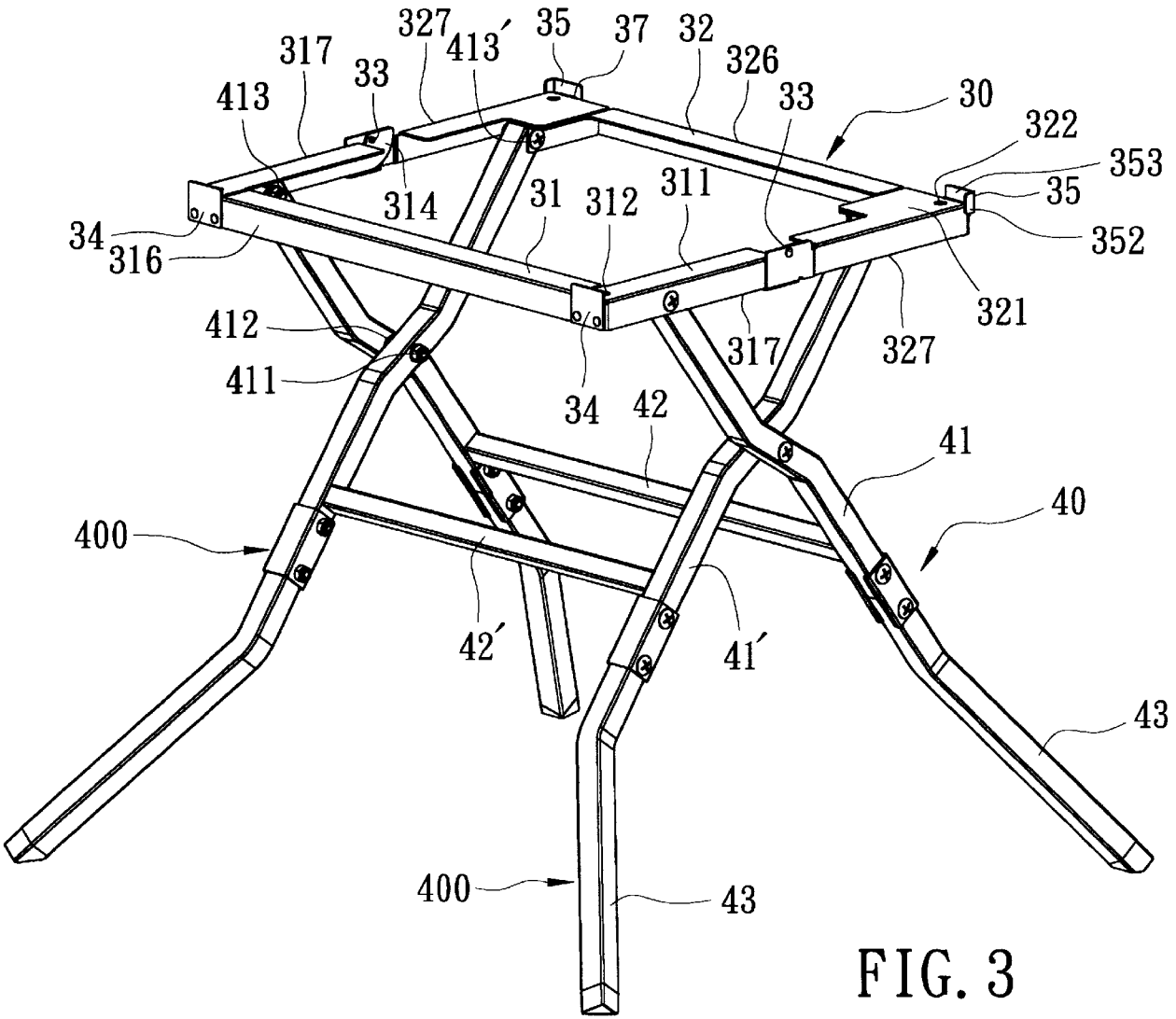
FIG. 3 is a perspective view of a preferred embodiment of the foldable table frame of the present invention in an unfolded state.
Figure 4:
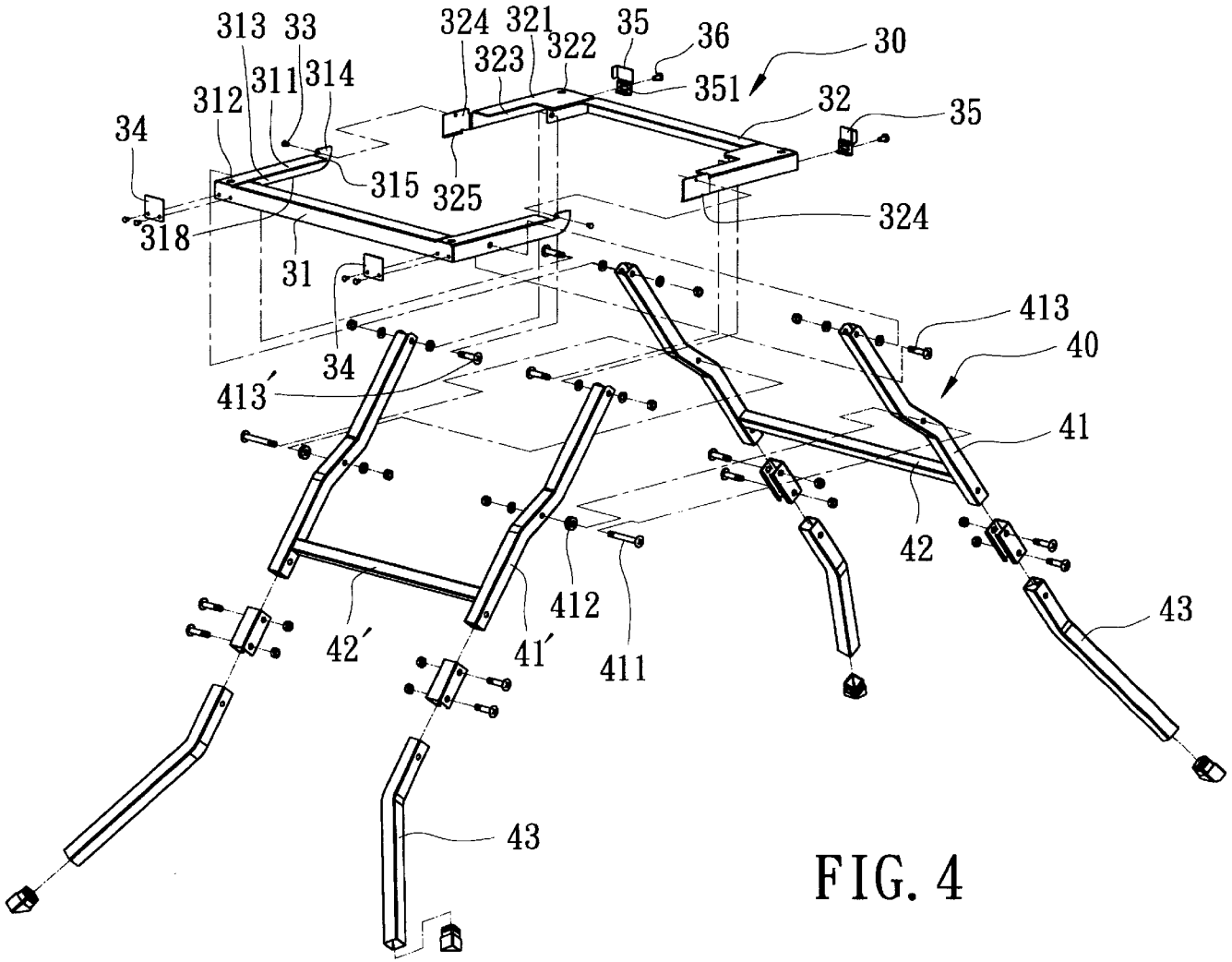
FIG. 4 is an exploded perspective view of the foldable table frame of the preferred embodiment.

Referring to FIGS. 3 and 4, the preferred embodiment of the foldable table frame according to the present invention is shown to include a tabletop unit 30 adapted to support a machine set (not shown) thereon, and a leg unit 40.

Figure 5:
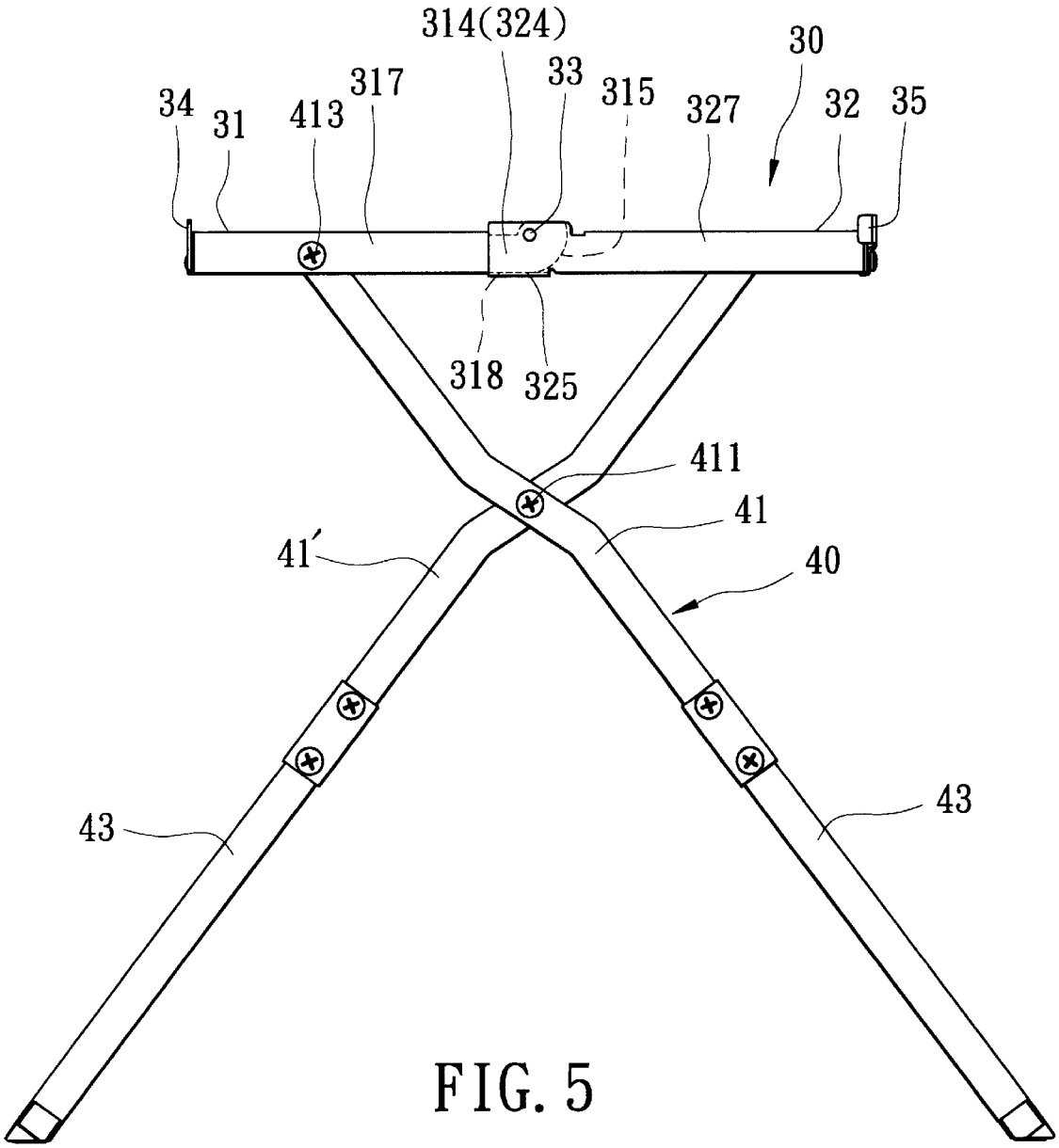
FIG. 5 is a lateral side view of the preferred embodiment in the unfolded state.
Figure 6:
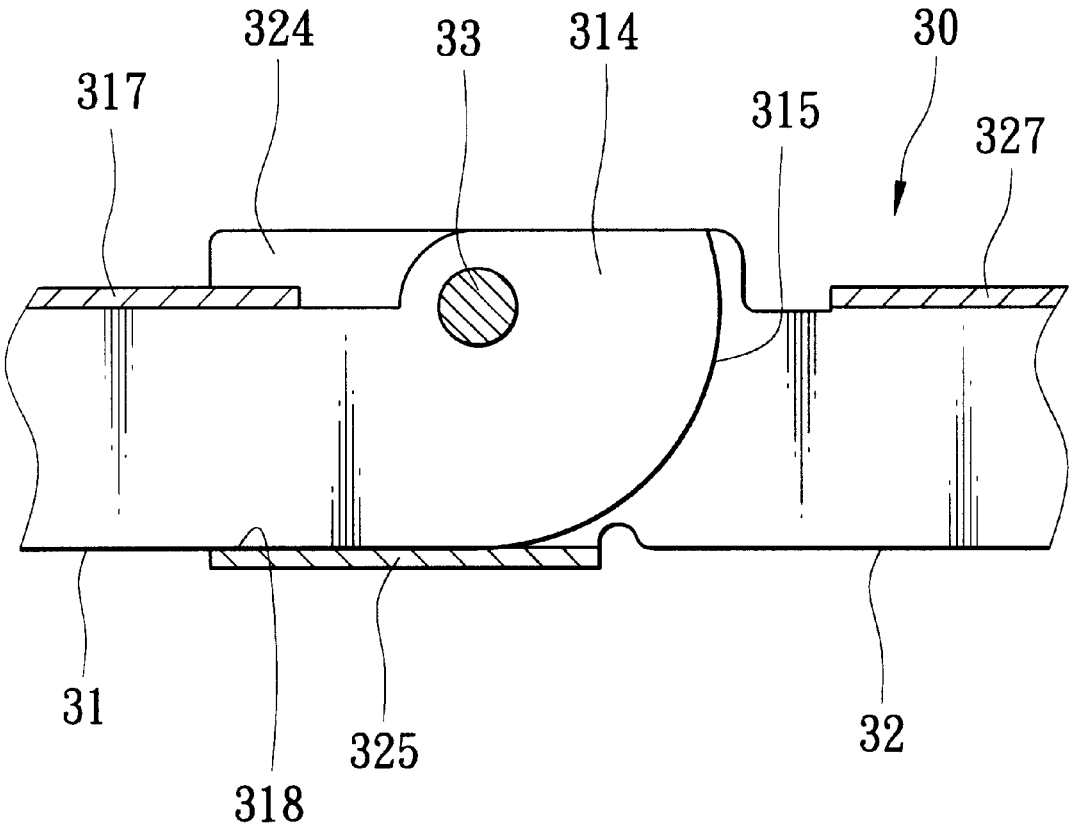
FIG. 6 is an enlarged fragmentary sectional view illustrating relative positions between front and rear frame members of a tabletop unit of the foldable table frame of the preferred embodiment in the state shown in FIG. 5.
Figure 7:
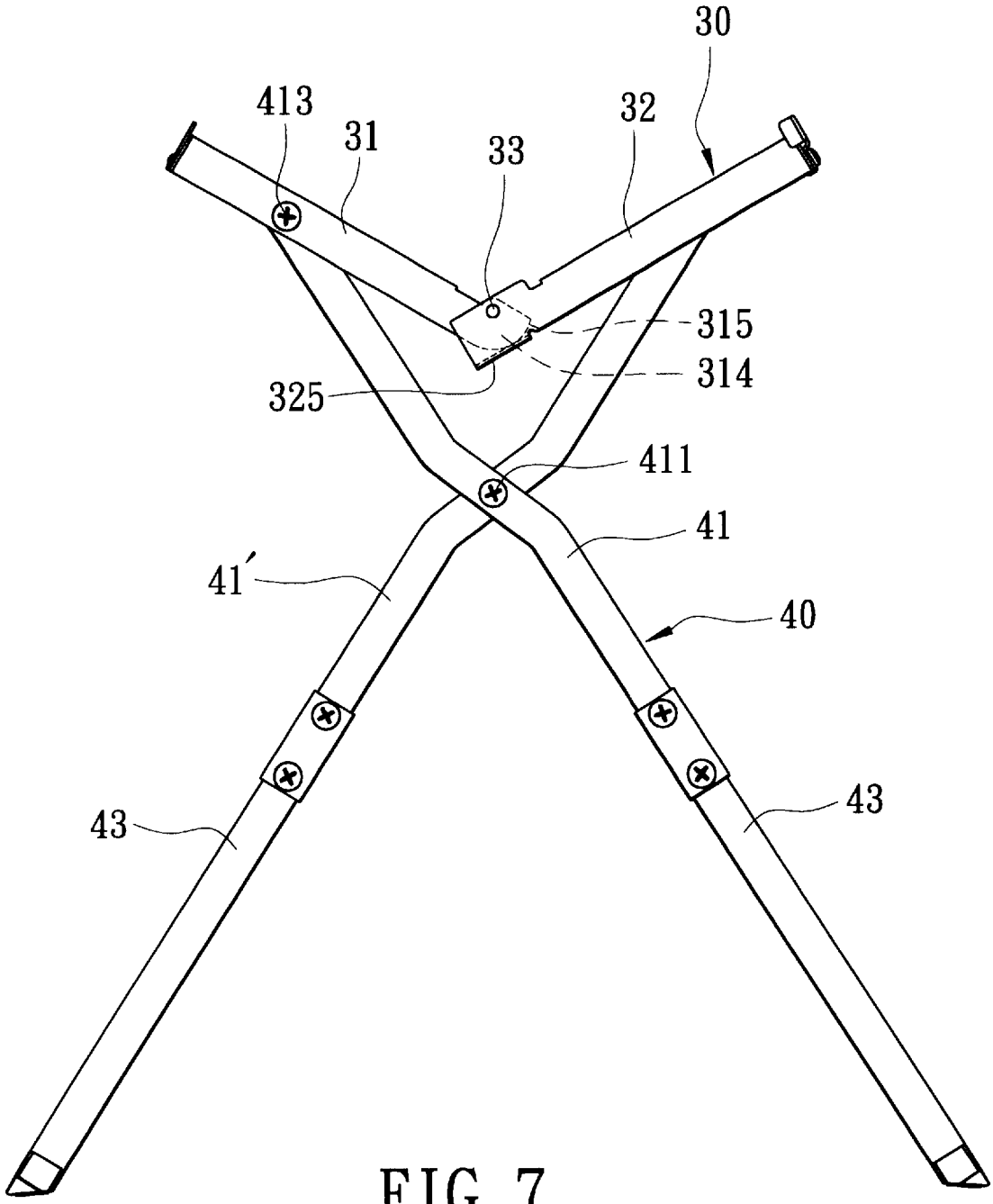
FIG. 7 is a lateral side view of the preferred embodiment during a folding operation.
Figure 8:
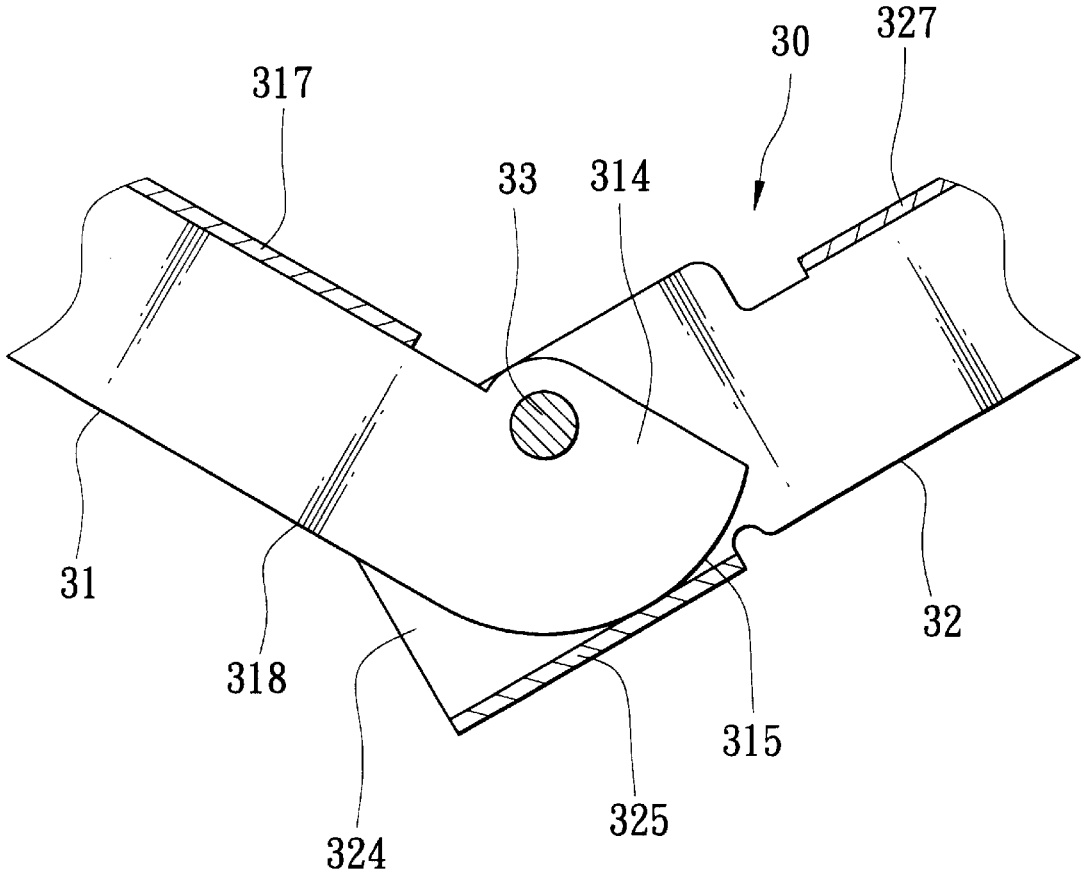
FIG. 8 is an enlarged fragmentary sectional view illustrating the relative positions between the front and rear frame members of the tabletop unit in the state shown in FIG. 7.

The tabletop unit 30 includes front and rear frame members 31, 32, each of which has a U-shaped configuration and a top wall 311, 321 adapted to permit placing of the machine set thereon. The top walls 311, 321 are formed with fastener holes 322, 312 around corners thereof to permit extension of fasteners (not shown) therethrough for fastening the machine set on the top walls 311, 321. The front frame member 31 includes parallel first lateral rods 317, and a horizontal front bar 316 extending transversely between front ends of the first lateral rods 317. The rear frame member 32 includes parallel second lateral rods 327, and a horizontal rear bar 326 extending transversely between rear ends of the second lateral rods 327. Each of the first and second lateral rods 317, 327 has an inverted L-shaped cross-section which defines a bottom recess 313, 323 on a bottom side of the respective one of the lateral rods 317, 327. The first lateral rods 317 have rear ends connected pivotally and respectively to front ends of the second lateral rods 327 using a pair of first pivot shafts 33 which extend along an upper pivot axis that is parallel to the front and rear bars 316, 326 such that the front and rear frame members 31, 32 are pivotable relative to each other about the upper pivot axis for moving the tabletop unit 30 between an unfolded position and a folded position. The rear end of each of the first lateral rods 317 is formed with an end plate 314 which has a respective one of the first pivot shafts 33 extending therethrough and which has a convex edge 315 that is connected to a longitudinal bottom edge 318 of a respective one of the first lateral rods 317. The front end of each of the second lateral rods 327 is formed with an L-shaped end piece 324 which is pivoted to the end plate 314 on the corresponding one of the first lateral rods 317 using the respective first pivot shaft 33 and which includes an abutment portion 325 that is transverse to the end plate 314 of the respective one of the first lateral rods 317. As shown in FIGS. 5 and 6, when the tabletop unit 30 is in the unfolded position, the longitudinal bottom edge 318 of each of the first lateral rods 317 abuts against the abutment portion 325 on the end piece 324 of the corresponding one of the second lateral rods 327, thereby retaining the tabletop unit 30 at the unfolded position. In this situation, the top walls 311, 321 of the front and rear frame members 31, 32 extend horizontally and are co-planar with each other so as to be adapted to cooperatively support the machine set thereon. When the tabletop unit 30 is moved to the folded position shown in FIG. 9, the first and second lateral rods 317, 327 are turned upright to enable the front and rear bars 316, 326 to move proximate to each other. Referring to FIGS. 7 and 8, the convex edge 315 of the end piece 314 of each of the first lateral rods 317 moves along a top surface of the abutment portion 325 of the end piece 324 on the front end of the respective one of the second lateral rods 327 during movement of the tabletop unit 30 between the folded and unfolded positions.

Figure 11:
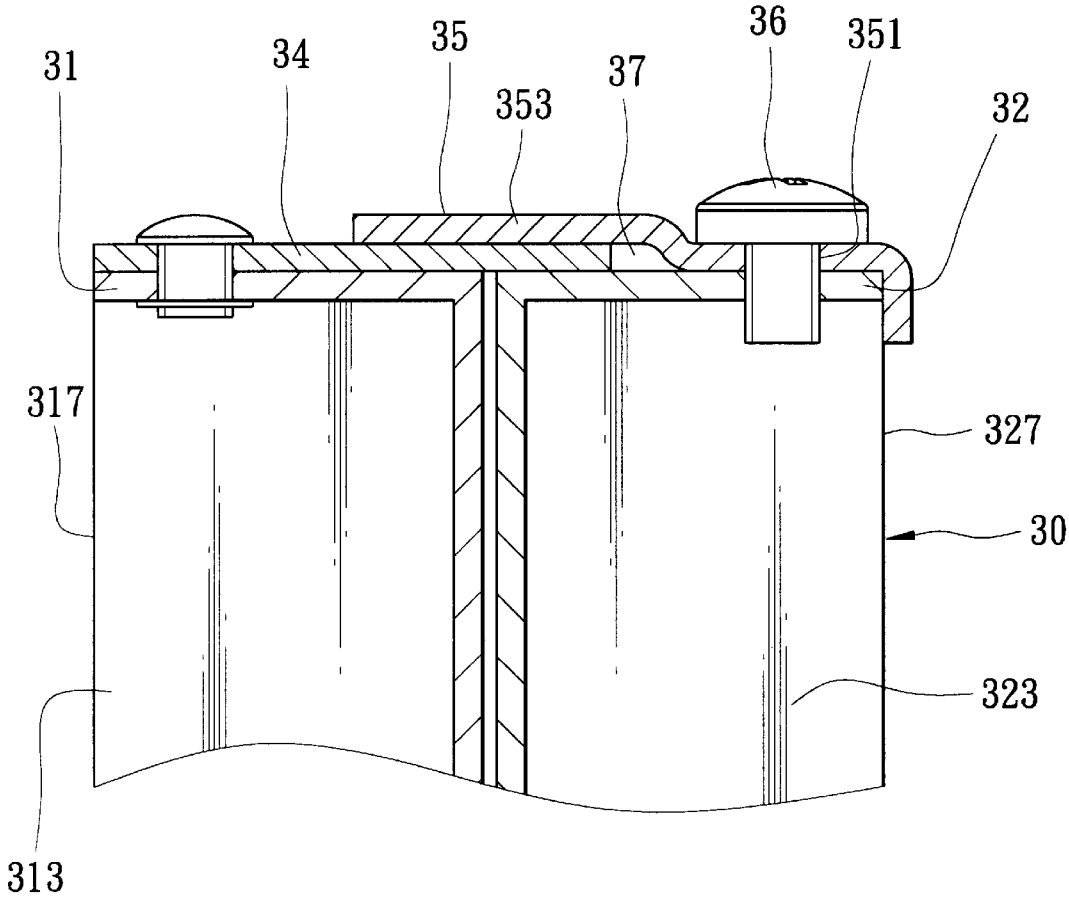
FIG. 11 is an enlarged fragmentary sectional view illustrating relative positions between front and rear limiting plates of the tabletop unit in the state shown in FIG. 10.

Referring back to FIGS. 3 and 4, the front bar 316 has a front side wall that faces forwardly when the tabletop unit 30 is in the unfolded position. The rear bar 326 has a rear side wall that faces rearwardly when the tabletop unit 30 is in the unfolded position. The front side wall of the front bar 316 has a pair of front limiting plates 34 mounted thereon. The front limiting plates 34 project upwardly relative to the top wall 311 of the front frame member 31. The rear side wall of the rear bar 326 has a pair of rear limiting plates 35 mounted thereon. The rear limiting plates 35 project upwardly relative to the top wall 321 of the rear frame member 32. The rear limiting plates 35 are generally L-shaped, and include a first limiting part 353 disposed on the rear side wall of the rear bar 326, and a second limiting part 352 extending transversely from the first limiting part 353 and extending to a lateral surface on an outer side of a respective one of the second lateral rods 327. The first limiting part 353 is formed with an elongated slot 351 which permits extension of a fastener 36 therethrough for mounting the rear limiting plate 35 adjustably on the rear bar 326. The front and rear limiting plates 34, 35 are adapted to cooperatively limit the machine set on the tabletop unit 30 to prevent the machine set from accidentally falling down from the tabletop unit 30. The first limiting portion 353 of each of the rear limiting plates 35 forms a clearance 37 with the rear side wall of the rear bar 32. The front limiting plates 34 are inserted respectively into the clearances 37 when the tabletop unit 30 is in the folded position, as best shown in FIG. 11.

Referring again to FIGS. 3 and 4, the leg unit 40 includes a pair of X-shaped leg frame portions 400, each of which includes first and second leg members 41, 41' that have upper and lower ends, and intermediate sections pivoted to each other using a respective second pivot shaft 411. The second pivot shafts 411 on the X-shaped leg frame portions 400 extend along a horizontal lower pivot axis that is located below and that is parallel to the upper pivot axis of the first pivot shafts 33. A packing ring 412 is disposed between the intermediate sections of the first and second leg members 41, 41' to smoothen relative movement between the first and second leg members 41, 41'. The leg unit 40 further includes parallel front and rear linking rods 42', 42. The front linking rod 42' extends transversely between and interconnects the second leg members 41' of the X-shaped leg frame portions 400. The rear linking rod 42 extends transversely between and interconnects the first leg members 41 of the X-shaped leg frame portions 400. The front and rear linking rods 42', 42 are located at a height lower than the lower pivot axis of the second pivot shafts 411. The upper ends of the first leg members 41 of the X-shaped leg frame portions 400 extend respectively into the recesses 313 in the first lateral rods 317 of the front frame member 31 of the tabletop unit 30, and are pivoted respectively to the first lateral rods 317 using an aligned pair of third pivot shafts 413 that extend along a front pivot axis parallel to the upper pivot axis of the first pivot shafts 33. The upper ends of the second leg members 41' of the leg frame portions 400 extend respectively into the recesses 323 in the second lateral rods 327, and are pivoted respectively to the second lateral rods 327 of the rear frame member 32 of the tabletop unit 30 using an aligned pair of fourth pivot shafts 413' that extend along a rear pivot axis parallel to the upper pivot axis of the first pivot shafts 33. In the present invention, the third pivot shafts 413 are displaced from the front bar 316, and the fourth pivot shafts 413' are displaced from the rear bar 326 such that the angle formed between upper sections of the first and second leg members 41, 41' is reduced, to result in an increased height of the leg unit 40 when unfolded.

When the tabletop unit 30 is in the unfolded position shown in FIGS. 3 and 5, the first and second leg members 41, 41' of each of the X-shaped leg frame portions 400 are unfolded from each other, and the tabletop unit 30 is supported by the leg unit 40 in a horizontal position so as to be adapted to permit placing of the machine set (not shown) on the top walls 311, 321.

Referring to FIG. 7, during folding and unfolding operation of the tabletop unit 30, the first and second leg members 41, 41' of each of the X-shaped leg frame portions 400 are moved together with the first and second lateral rods 317, 327 and pivot relative to each other about the lower pivot axis of the second pivot shafts 411 for folding toward and for unfolding from each other.

Figure 9:
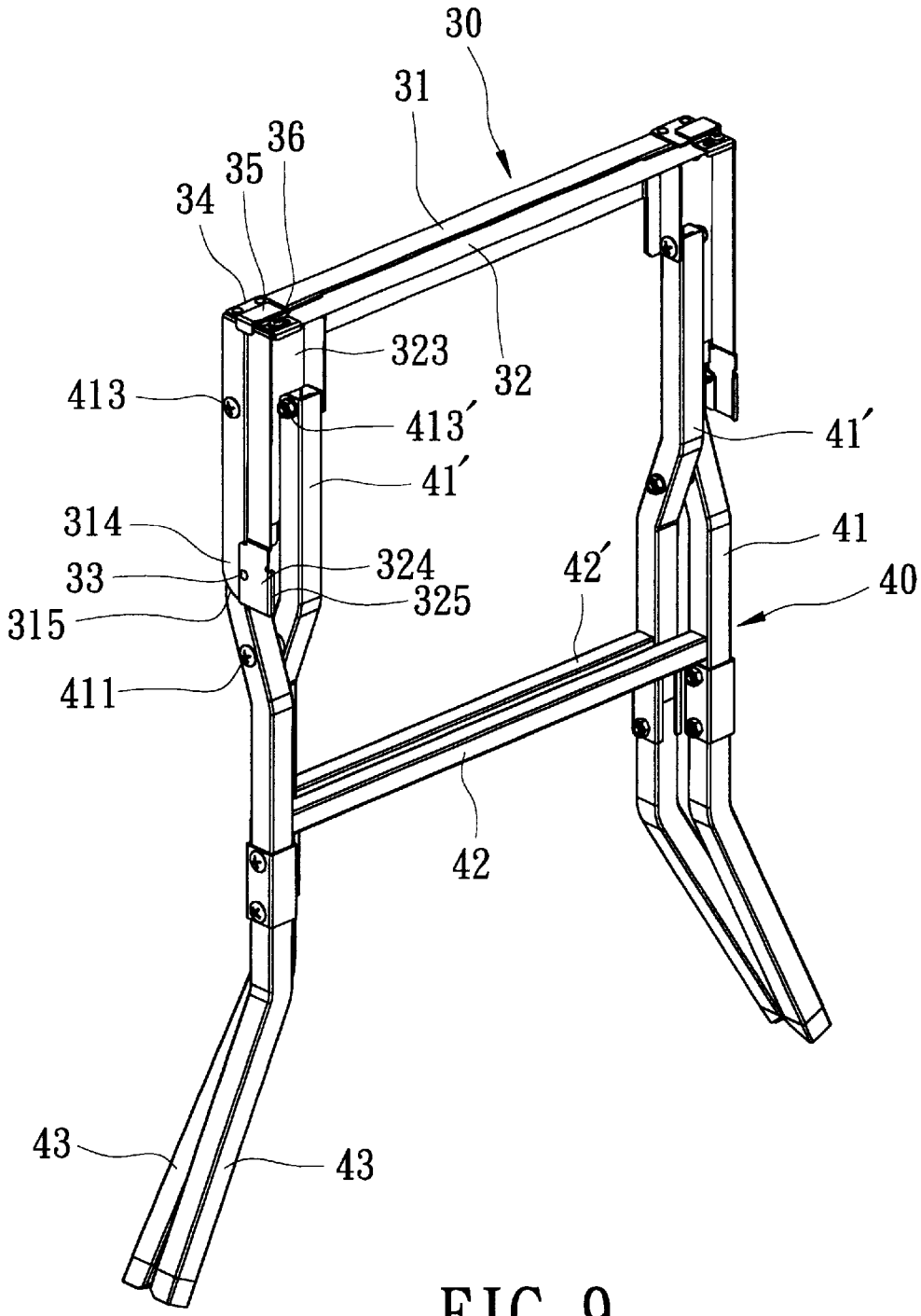
FIG. 9 is a perspective view of the foldable table frame of the preferred embodiment in a folded state.
Figure 10:
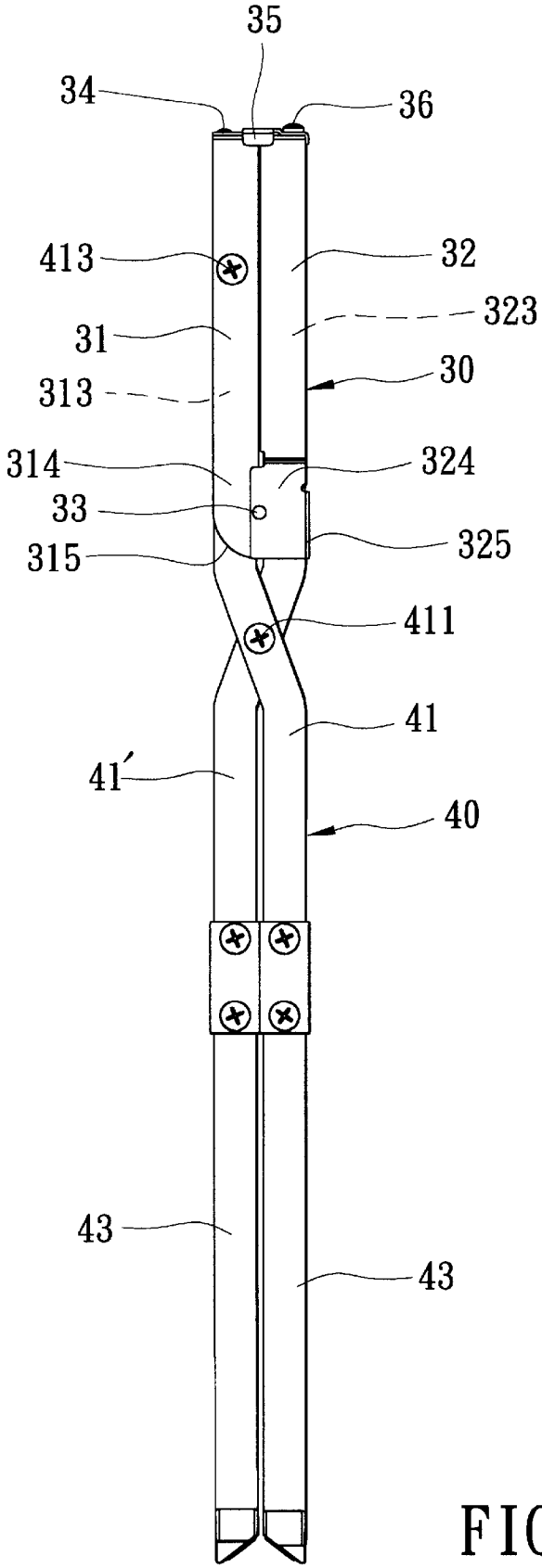
FIG. 10 is a lateral side view of the preferred embodiment in the state shown in FIG. 9.
Figure 12:
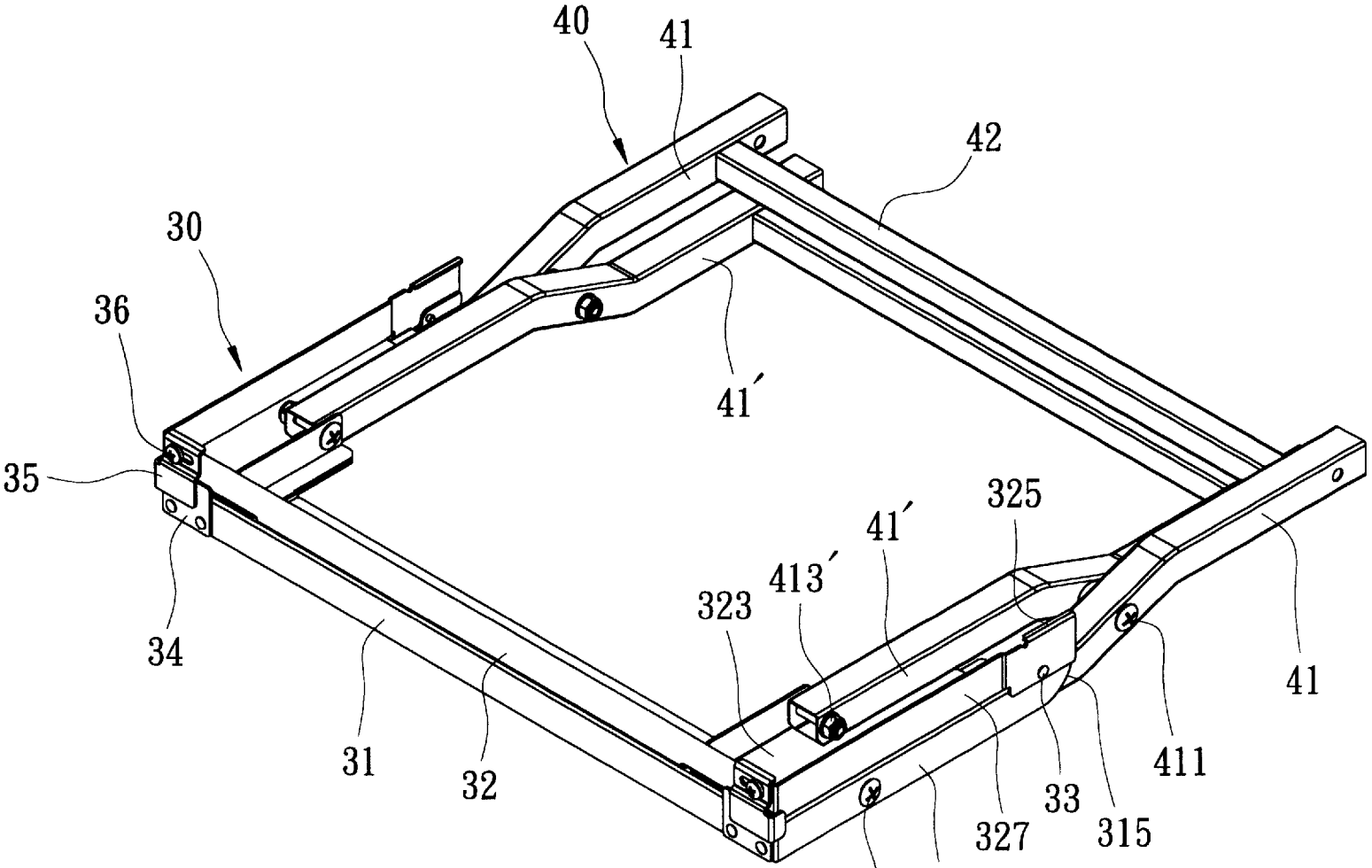
FIG. 12 is a perspective view of the foldable table frame of the preferred embodiment in the folded state, where lower sections of leg members are detached and removed therefrom.

Referring to FIGS. 9 and 10, when the tabletop unit 30 is moved to the folded position, the upper section of the first leg member 41 of each of the X-shaped leg frame portions 400 is extended into the bottom recess 313 of a respective one of the first lateral rods 317. Similarly, the upper section of the second leg member 41' of each of the X-shaped leg frame portions 400 is extended into the bottom recess 323 of a respective one of the second lateral rods 327. As such, the entire table frame, when folded, forms a generally rectangular frame (see FIG. 12) that has a thickness which is about twice the thickness of the leg members 41, 41'.

It is noted that, in the present embodiment, each of the first and second leg members 41, 41' has a detachable lower section 43 disposed at a level lower than the lower pivot axis of the second pivot shafts 411. The detachable lower section 43 of each of the first and second leg members 41, 41' can be detached when the table frame is not in use, and can be subsequently disposed within the rectangular frame when the table frame is folded.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable table frame comprising:

a tabletop unit including front and rear frame members, each of which has a U-shaped configuration, said front frame member including parallel first lateral rods with front and rear ends and a horizontal front bar extending transversely between said front ends of said first lateral rods, said rear frame member including parallel second lateral rods with front and rear ends and a horizontal rear bar extending transversely between said rear ends of said second lateral rods, each of said front and rear frame members having a top wall, said rear ends of said first lateral rods of said front frame member being connected pivotally and respectively to said front ends of said second lateral rods of said rear frame member such that said front and rear frame members are pivotable relative to each other about a horizontal upper pivot axis parallel to said front and rear bars, each of said first and second lateral rods of said front and rear frame members having a bottom side formed with a recess, said rear end of each of said first lateral rods having an end plate which has a convex edge, said front end of each of said second lateral rods having an end piece which is pivoted to said end plate of the respective one of said first lateral rods for pivoting about said upper pivot axis and which has an abutment portion that is transverse to said end plate of the respective one of said first lateral rods, said tabletop unit being movable between an unfolded position, in which said top wall of said front frame member extends horizontally and is coplanar with said top wall of said rear frame member, and a folded position in which said first and second lateral rods are turned upright to enable said front and rear bars to move proximate to each other, said convex edge on said rear end of each of said first lateral rods moving along said abutment portion on said front end of the respective one of said second lateral rods during movement of said front and rear frame members between the folded and unfolded positions; and a leg unit which includes a pair of X-shaped leg frame portions, each of which includes first and second leg members having upper and lower ends and intermediate sections pivoted to each other about a lower pivot axis that is located below and that is parallel to said upper pivot axis, said upper ends of said first leg members of said leg frame portions being pivoted respectively to said first lateral rods of said front frame member about a horizontal front pivot axis parallel to said upper pivot axis, said upper ends of said second leg members of said leg frame portions being pivoted respectively to said second lateral rods of said rear frame member of said tabletop unit about a horizontal rear pivot axis parallel to said front pivot axis, said first and second leg members of each of said leg frame portions being movable together with said first and second lateral rods and pivoting relative to each other about said lower pivot axis for folding toward and for unfolding from each other when said tabletop unit is moved between the folded and unfolded positions, said first and second leg members of said leg frame portions extending respectively into said recesses of said first and second lateral rods of said front and rear frame members of said tabletop unit when said tabletop unit is moved to the folded position.

2. The foldable table frame as claimed in claim 1, wherein each of said first lateral rods has a longitudinal bottom edge connected to said convex edge of said end plate, said bottom edge abutting against said abutment portion on said front end of the respective one of said second lateral rods when said tabletop unit is in the unfolded position.

3. The foldable table frame as claimed in claim 1, wherein said front bar has a front sidewall that faces forwardly when said tabletop unit is in the unfolded position, said rear bar having a rear side wall that faces rearwardly when said tabletop unit is in the unfolded position, said tabletop unit further including a pair of front limiting plates which are mounted on said front side wall and which project upwardly relative to said top wall of said front frame member when said tabletop unit is in the unfolded position, and a pair of rear limiting plates which are mounted on said rear side wall and which project upwardly relative to said top wall of said rear frame member when said tabletop unit is in the unfolded position.

4. The foldable table frame as claimed in claim 3, wherein each of said rear limiting plates forms a clearance from said rear side wall of said rear bar, said first limiting plates being inserted respectively into said clearances when said tabletop unit is in the folded position.

5. The foldable table frame as claimed in claim 3, wherein said second lateral rods have opposite outer sides formed with lateral surfaces, each of said rear limiting plates having an L-shaped configuration and including a first limiting part disposed on said rear side wall of said rear bar, and a second limiting part extending transversely from said first limiting part and extending to said lateral surface of a respective one of said second lateral rods, said first limiting part being formed with an elongated slot, said tabletop unit further including a pair of fasteners extending through said elongated slots in said rear limiting plates for mounting said rear limiting plates adjustably on said rear bar.

6. The foldable table frame as claimed in claim 1, wherein said front pivot axis is displaced from said front bar, and said rear pivot axis is displaced from said rear bar.

7. The foldable table frame as claimed in claim 1, wherein said leg unit further includes a front linking rod which extends transversely between and which interconnects said second leg members of said X-shaped leg frame portions, and a rear linking rod which is parallel to said front linking rod and which interconnects said first leg members of said X-shaped leg frame portions, said front and rear linking rods being disposed at a height lower than said lower pivot axis.

8. The foldable support frame assembly as claimed in claim 1, wherein each of said first and second leg members of said X-shaped leg frame portions includes a detachable lower section that is disposed at a level lower than said lower pivot axis.

* * * * *